US007272958B2

(12) United States Patent
Fehrenbacher et al.

(10) Patent No.: US 7,272,958 B2
(45) Date of Patent: Sep. 25, 2007

(54) LATCH NEEDLE FOR TEXTILE MACHINES

(75) Inventors: Eckhard Fehrenbacher, Bondorf (DE); Uwe Hennig, Burladingen (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/449,663

(22) Filed: Jun. 9, 2006

(65) Prior Publication Data

US 2006/0277949 A1 Dec. 14, 2006

(30) Foreign Application Priority Data

Jun. 9, 2005 (EP) ..... 05012412

(51) Int. Cl.
*D04B 35/04* (2006.01)

(52) U.S. Cl. ..... 66/121

(58) Field of Classification Search ..... 66/121, 66/122, 116

See application file for complete search history.

(56) References Cited

U.S. PATENT DOCUMENTS

| | | | | |
|---|---|---|---|---|
| 938,795 | A * | 11/1909 | Scott | 66/121 |
| 1,032,613 | A | 7/1912 | Korndoerfer, Jr. | |
| 6,510,714 | B2 * | 1/2003 | Dehner | 66/121 |

FOREIGN PATENT DOCUMENTS

| | | |
|---|---|---|
| DE | 586 678 C | 10/1933 |
| DE | AS 1113537 | 9/1961 |
| DE | OS 43 24 232 1 | 1/1995 |
| DE | 43 34 051 C1 | 2/1995 |
| GB | 06666 | 4/1909 |
| GB | 1 591-613 A | 6/1981 |

OTHER PUBLICATIONS

European Search Report dated Dec. 29, 2005.

* cited by examiner

*Primary Examiner*—Danny Worrell
(74) *Attorney, Agent, or Firm*—Fitch Even Tabin & Flannery; Norman N. Kunitz

(57) ABSTRACT

A novel latch needle has a sawslot (11) which is provided with facets or surfaces (22, 25) both at its frontal and its rearward end surfaces (18, 19). The surfaces (22, 25) are preferably parallel to one another and are oriented perpendicularly to the direction of length (L) of the shank. By virtue of this arrangement the surfaces are so oriented that the latch (6), as it opens or closes, pushes any dirt past the respective surfaces through the sawslot (11) and thus an accumulation and compacting of dirt cushions on the noted surfaces is avoided. Generally stated, the sawslot (11), particularly in the region of its end surfaces (18, 19) is thus void of any surface regions which represent an obstacle to the opening or closing latch (6).

18 Claims, 6 Drawing Sheets

LATCH NEEDLE FOR TEXTILE MACHINES

CROSS REFERENCE TO RELATED APPLICATION

This application claims the priority of European Patent Application No. 05 012 412.2, filed on Jun. 9, 2005, the subject matter of which, in its entirety, is incorporated herein by reference.

BACKGROUND OF THE INVENTION

The present invention relates to a latch needle adapted for use in textile machines, such as knitting machines or knitting looms.

For the manufacture of knit ware latch needles of the prior art have been known which have an elongated shank carrying a hook at an end and which are further provided with a latch pivotally supported in a longitudinal sawslot. In one position the latch is, with its end, in contact with the hook (closed position). The latch may be pivoted away from the hook into its reverse position for opening the hook.

A needle of the above type is disclosed, for example, in German Offenlegungsschrift (Application Published Without Examination) DE OS 27 14 607. For dampening the impact energy of the latch in the rearward position, a first longitudinal slot, open in the direction of the needle back, is adjoined by a second longitudinal slot. The latter is disposed below the reverse latch position and has a depth which is greater than one half of the height of the needle shank. The structuring of a latch needle according to DE OS 27 14 607 (also referred to in the art as a dual-slot needle) increases the elasticity of the shank cheeks and thus has a dampening effect.

Further, German Offenlegungsschrift (Application Published Without Examination) DE OS 43 24 232 describes a latch needle which, below the seating surface for the latch in its reverse position, is provided with means constituting an aperture extending from the needle breast to the needle back. This measure increases the deformability of the shank cheeks, thus generating a dampening effect.

It is a common characteristic of the needles described in the above patent documents that in addition to the sawslot in which the latch is pivotally held, they have additional recesses, for example a slot or an aperture, requiring additional process steps in their manufacture.

Further, German Patent No. DE 43 34 051 C1 discloses a needle which, for receiving the latch, has a sawslot starting from the needle breast. The sawslot, relative to the length direction of the shank, has essentially parallel-bordering flanks. At the hook-side end and the opposite end of the sawslot obliquely arranged, arcuate end faces are provided, so that, viewed from the needle breast, the length of the sawslot, relative to the length direction of the shank, decreases inward, that is, toward the depth of the sawslot.

The sawslot is provided at its underside with an aperture open toward the needle back. The aperture is bordered by parallel flanks and has at its hook-side end as well as at its opposite end a small, preferably planar end surface oriented perpendicularly the length direction of the shank.

The aperture leading to the needle back may be utilized for removing from the sawslot dirt which gathers therein during the knitting process.

Further, German Patent No. 586678 describes a latch needle having a sawslot which flares in a funnel-like manner toward the needle back. Relative to the length direction of the shank, the sawslot is bordered by two cheeks, whose inner surfaces form an acute angle with one another. The length of the sawslot increases toward the needle back in the length direction of the shank. Similarly, the length of the sawslot increases toward the needle breast from a short (viewed in the length direction of the shank), approximately mid region of the sawslot.

At the side oriented toward the latch and the needle breast, particularly the hook-side end of the sawslot is formed by a slightly arcuate inclined surface which forms an acute angle with the length direction of the shank. Although the enlargement of the sawslot toward the needle back improves dirt removal according to the earlier noted patent document, it cannot be excluded that the latch, as it closes, presses dirt into the adjoining end surface of the sawslot, whereby a solid dirt body is being formed.

A similar effect may appear in latch needles which are provided with a latch spring for supporting selected pivotal positions of the latch. Such a needle is described, for example, in German Auslegeschrift (Application Published After Examination) DE-AS 1113537. In this needle too, the end surface of the sawslot adjoining the hook and the end surface opposite the hook, are inclined upward, so that as the latch moves, a dirt cushion may be build up on those surfaces. The passage toward the needle back blocked by the latch makes a self-cleaning and dirt removal difficult.

Patent Application P 102004049069.9, not yet published on the filing date of the present application, discloses a latch needle having a spring-supported latch, in which the latch spring is inserted into the sawslot from the needle back. As viewed from the needle back, the length of the sawslot measured in the length direction of the shank is reduced, while its depth increases. At the needle breast the hook-side end surface of the sawslot terminates in a small surface which is oriented perpendicularly or at an obtuse angle to the length direction of the shank and which faces away from the needle breast. This surface is disposed in such a manner that the latch, as it closes, just touches the end of this surface when the latch attains its closed position.

By means of such a measure the buildup of dirt cushions on an end surface of the sawslot by the closing latch may be avoided.

SUMMARY OF THE INVENTION

It is an object of the invention to provide a latch needle which has an increased elasticity as the latch impacts into its reverse position and whose properties with respect to soiling are improved.

The above object is achieved with a latch needle as defined in claim 1 and, in the alternative, with a latch needle as defined in claim 6. The invention may be applicable to two latch needle categories, that is, to latch needles with and without a latch spring. In case no latch spring is provided, at least one of the end-side surfaces (relative to the length direction of the shank) of the sawslot is oriented approximately perpendicularly to the length direction of the shank. In this manner the respective surface is so oriented that the direction of motion of the latch, shortly before it reaches its respective end position, is approximately parallel to the respective end-side surface. In this manner dirt pushed by the latch is not deposited on the end-side surface, but is pushed away in front thereof. This is of particular significance for the hook-side surface bordering the sawslot, for continuously ensuring a secure closing of the latch.

For increasing the elasticity of the latch needle, the distance of the end-side surface of the sawslot from the hook of the latch needle is, dependent from the desired elasticity of the shank cheeks, at least as large as, or larger than the distance of the latch spoon from the hook in the reverse position of the latch.

In case of latch needles provided with a latch spring, according to the invention both end-side surfaces of the sawslot adjoining the needle breast are essentially parallel to one another and approximately perpendicular or at an obtuse angle to the length direction of the shank. In case of an orientation at an obtuse angle of at least one of the surfaces adjoining the needle breast, the normal vector drawn to the surface is inclined away from the needle breast and directed into the sawslot and forms an acute angle with the length direction of the shank. As a result of the right angle or obtuse angle, in both end positions of the latch a buildup of a dirt layer on the end-side surfaces of the sawslot is prevented. As a result of the increase of the sawslot length in the direction of the needle back (relative to the length direction of the shank), dirt removal from the sawslot toward the needle back is facilitated despite the presence of the latch spring. This is particularly the case if the latch spring occupies only one part of the sawslot width, whereby dirt may pass by the latch spring toward the needle back.

Further details of advantageous embodiments of the latch needle according to the invention appear in the drawing in conjunction with the description and/or in the dependent claims.

DETAILED DESCRIPTION OF THE INVENTION

Figure 1:
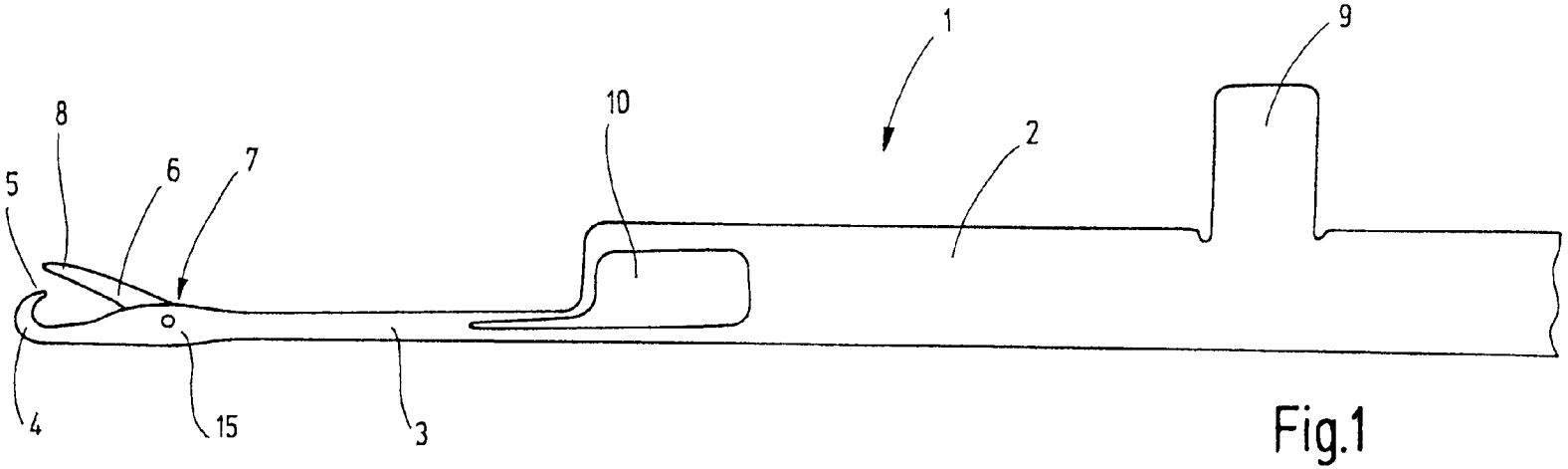
FIG. 1 is a schematic side elevational view of a latch needle.

The embodiments of the latch needle according to the invention shown in the individual Figures are divided into structures with and without a latch spring. The latch needle 1 illustrated in FIG. 1 may have a latch spring or may be without one. The details described below apply to either embodiment.

The latch needle 1 has a needle body 2 having an elongated shank 3 terminating in a hook 4 having a hook tip 5. Adjoining the hook, a latch 6 is provided which is pivotally supported by a latch bearing 7. By its back-and-forth pivoting motion, the latch 6 may contact the hook tip 7 with its spoon 8 to thus close the hook 4, or may open the hook 4 by assuming a reverse position.

The larch needle 1 further has at least one butt 9 extending upward from the needle body 2. If desired, the needle body 2 and/or the shank 3 may be provided with a transfer spring 10. The latter is provided, for example, at one of the planar lateral surfaces of the latch needle 1 and serves for transferring loops which are taken up by the shank 3, that is, it serves for the transfer of such loops to other needles.

Figure 2:
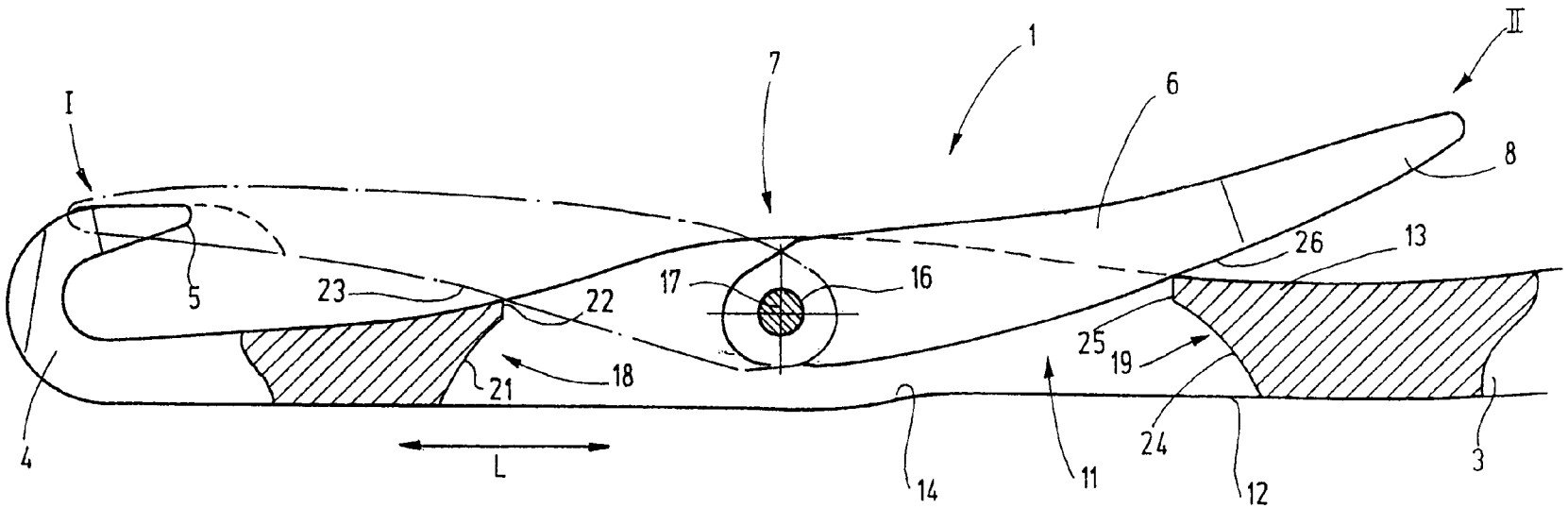
FIG. 2 is an enlarged, fragmentary, partially sectional illustration of the latch needle according to FIG. 1.

FIG. 2 shows in particular the structure of the latch needle 1. The latch 6 projects, with its end adjoining the latch bearing 7, into a sawslot 11 which is provided in the shank 3 as an elongated slot and which extends up to the needle breast 13. In case the shank 3 is cross-sectionally essentially rectangular, the needle back 12 is a narrow, preferably substantially planar surface, by means of which the latch needle 1 slides on the bottom of an associated needle bed of a knitting machine. The needle breast 13 is the oppositely disposed surface from which the latch 6 projects. Both sides of the sawslot are bordered by cheeks 14, 15. In FIG. 2 the cheek 15 facing the observer (and seen in FIG. 1) is cut away to thus expose to the observer the cheek 14 lying behind the latch 6. In this manner a pin 17 is made visible which passes through a latch hole 16 and which constitutes the latch bearing 7. The pin 17 is preferably perpendicularly oriented to the cheeks 14, 15 which border the sawslot 11 with their preferably planar and mutually perpendicularly oriented, facing inner sides. The longitudinal section of the sawslot 11 oriented parallel to the length direction L of the shank and perpendicularly to the cheeks 14, 15, that is, perpendicularly to the drawing plane, is therefore preferably rectangular at every location.

On each side of the latch bearing 7 the sawslot is bordered by end surfaces 18, 19. The end surface 18 is disposed between the latch bearing 7 and the hook 4. The end surface 19, on the other hand, is arranged at the oppositely located end of the sawslot and faces the end surface 18.

The end surface 18 is divided into an arcuate surface 21 and a preferably smaller surface 22 arranged at an angle to the surface 21 and adjoining the needle breast 13. While the surface 21 starting from the needle back 12 is preferably circularly, that is, cylindrically arcuate and forms with the length direction L of the shank an acute angle, whose point is oriented toward the hook 4, the surface 22 is essentially or—as manufacturing precision permits—exactly perpendicular to the length direction L of the shank. The surface 22 is preferably positioned in such a manner that the latch 6 engages, with its inner side 23, the upper, needle breast-side end of the surface 22 when the latch 6 is in its closed position I. The latch 6 may, however, also be situated at a small distance from the surface 22.

Similarly, the end surface 19 is divided into a larger, arcuate, preferably cylindrical surface 24 which adjoins the needle back 12 and—manufacturing accuracies permitting—a preferably planar surface 25 which adjoins the needle breast 13. The surface 25 is preferably parallel to the surface 22 and is therefore—manufacturing accuracies permitting—preferably perpendicular to the length direction L of the shank. The surface 24, on the other hand, forms, with the length direction L of the shank, an acute angle whose point is oriented away from the hook 4 of the needle 1.

The sawslot 11 thus has at the needle breast 13 a length which is measured in the length direction L of the shank and which is less than the length measured at the needle back 12.

Further, the surfaces 21 and 24 are divergent. In this manner the sawslot 11 flares toward the needle back 12, at least as concerns its length direction. The sawslot 11, however, preferably does not flare in the transverse direction since, as noted earlier, the cheeks 14, 15 are oriented parallel to one another.

The latch needle 1 described up to this point is exposed to reduced soiling and has a superior self-cleaning effect. In operation, the latch 6 is continuously reciprocated between the closed position I and the reverse position II. During such an occurrence any dirt deposited on the needle breast 13 is moved, by virtue of the flaring sawslot 11, past the surfaces 22, 25 toward the needle back 12 where it can freely exit.

Figure 2B:
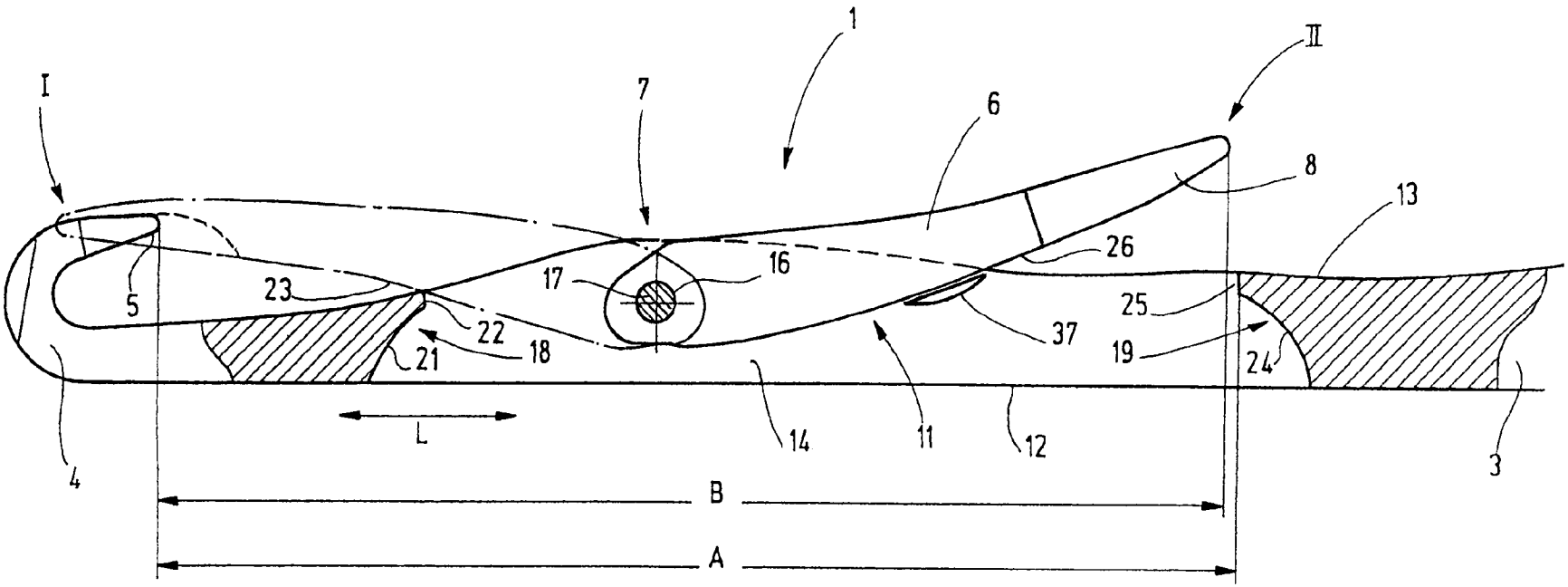
FIG. 2*b* is a longitudinally partially sectional illustration of a modified embodiment of the latch needle according to FIG. 2, having a larger sawslot.

FIG. 2*b* shows a modified embodiment which is similar to that of FIG. 2 but in which the shank cheeks 14, 15 have an increased elasticity. Inasmuch as constructional, functional and structural identity to the earlier described latch needle 1 of FIG. 2 are present, reference is made to the earlier description while using the same reference numerals. This applies without limitation with the exception of the differences now to be described.

As a departure from the latch needle 1 of FIG. 2, the latch needle 1 according to FIG. 2*b* has a planar needle back 12 which extends in a plane over the entire shank length 3. Needles may also be provided, whose needle back 12 has a planar shape and which additionally have a raised hook position as it is known in the art.

Additionally, the latch needle 1 according to FIG. 2*b* has a throughgoing sawslot 11 which extends starting from a region between the hook tip 5 and the latch bearing 7 up to the end of, or beyond the latch spoon 8 when the latter is in its reverse position II. In this manner a latch needle 1 is obtained which has highly elastic cheeks 14, 15. The distance A from the hook tip 5 to the surface 25 of the end surface 19 of the sawslot 11 is greater than, or at least as large as the distance B from the hook tip 5 to the end of the latch spoon 8. In such a case the seating of the latch spoon is provided exclusively by an embossment 37, resulting in a particularly flexible latch needle. The embossment 37 which may be provided only on one, or may be provided on both cheeks that border the shank, projects from the respective cheek into the sawslot 11 and constricts or obturates the same and has a seating surface conforming to the shape of the back of the latch spoon.

Figure 3:
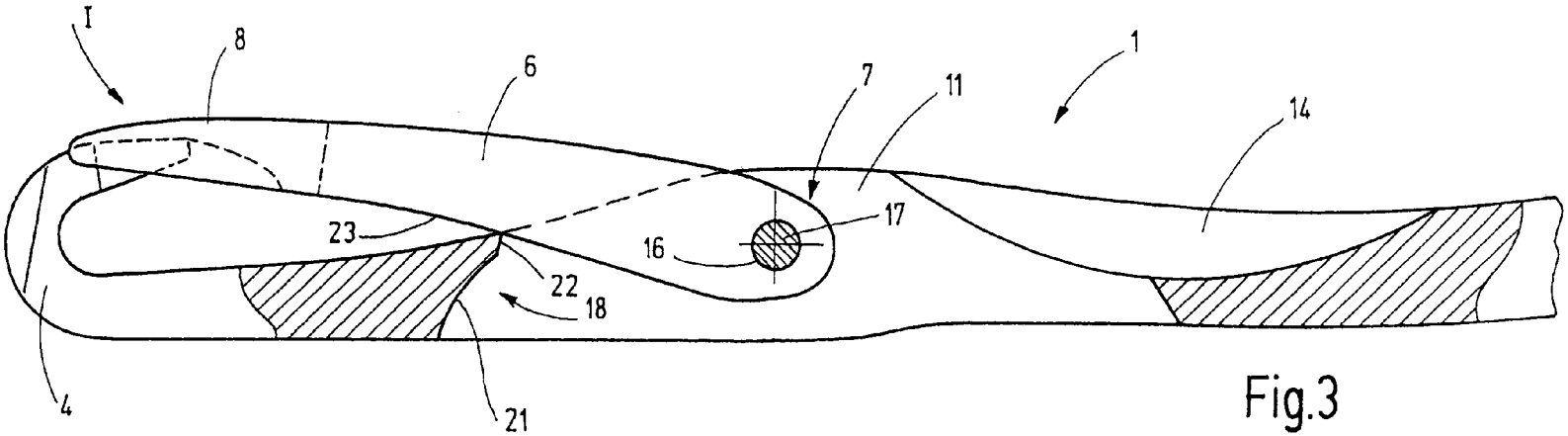
FIG. 3 is a fragmentary, longitudinally partially sectional illustration of a modified embodiment of the latch needle according to FIG. 2, showing the latch in its closed position.
Figure 4:
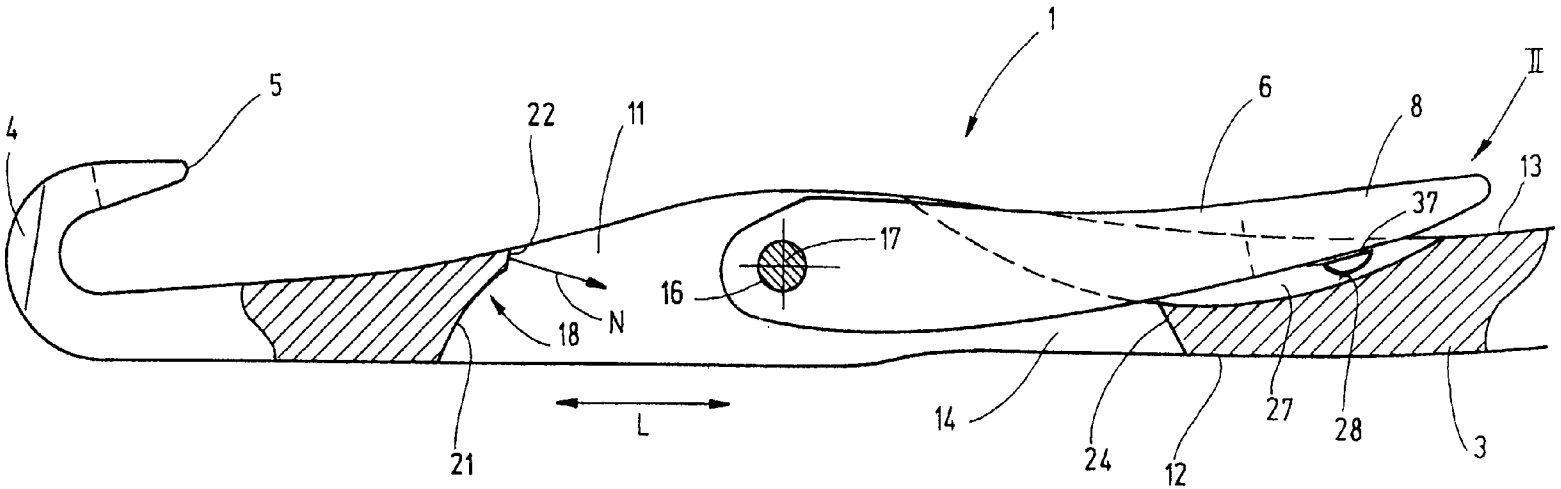
FIG. 4 shows the latch needle of FIG. 3, illustrating its latch in the reverse position.

FIGS. 3 and 4 illustrate a further modified embodiment of the latch needle 1 which also operates without a latch spring. Inasmuch as constructional, functional and structural identity to the earlier described latch needle 1 of FIG. 2 are present, reference is made to the earlier description while using the same reference numerals. This applies without limitation with the exception of the differences now to be described.

The latch needle 1 according to FIGS. 3 and 4 differs from the latch needle 1 of FIG. 1 merely in the described end surface 18 at the hook-side end of the sawslot 11. The surface 22 may be oriented perpendicularly or, as shown, at an obtuse angle to the length direction L of the shank. In the latter case the normal vector N of the surface 22 forms an acute angle with the length direction L of the shank and is oriented into the sawslot 11, that is, it points away from the needle breast 13. The surface is oriented preferably in such a manner that in the closed position I it forms approximately or exactly an angle of 90° with the inner side 23 of the latch 6. In such a case the latch 6 may then lie against the upper edge adjoining the surface 22 or be situated at a distance therefrom.

The oppositely located end of the sawslot 11 is configured differently. Starting from the needle back 12, the surface 24 extends into the sawslot 11 only for a short distance which is preferably shorter than one half of the shank thickness. At that location the surface 24 adjoins a depression 27 which is provided in the shank 3 from the side of the needle breast 13 and which intersects the sawslot 11. The depression 27 has a preferably circularly arcuate, that is, a partially cylindrical bottom 28 and forms with the embossment 37 a seat for the spoon 8 of the latch 6 for the reverse position of the latch 6. The spoon 8 which is slightly wider than the rest of the larch 6, is partially received in the reverse position by the depression 27 and the embossment 37. By virtue of the respective cheeks 14, 15 weakened by the depression 27 (in FIGS. 3 and 4 only the cheek 14 is visible), a certain resiliency and thus a dampened impact of the latch 6 are obtained.

As concerns the cleaning effect, the latch needle 1 is still superior to conventional latch needles. Dust and dirt, deposited particularly in the inner space of the hook are, by means of the latch 6, advanced to the needle back 12 through the sawslot 11 and thus ejected therefrom. Since the sawslot 11 is entirely closed toward the hook 4 when the latch is in its closed position, the extent of dirt introduction into the sawslot 11 is additionally reduced.

Figure 5:
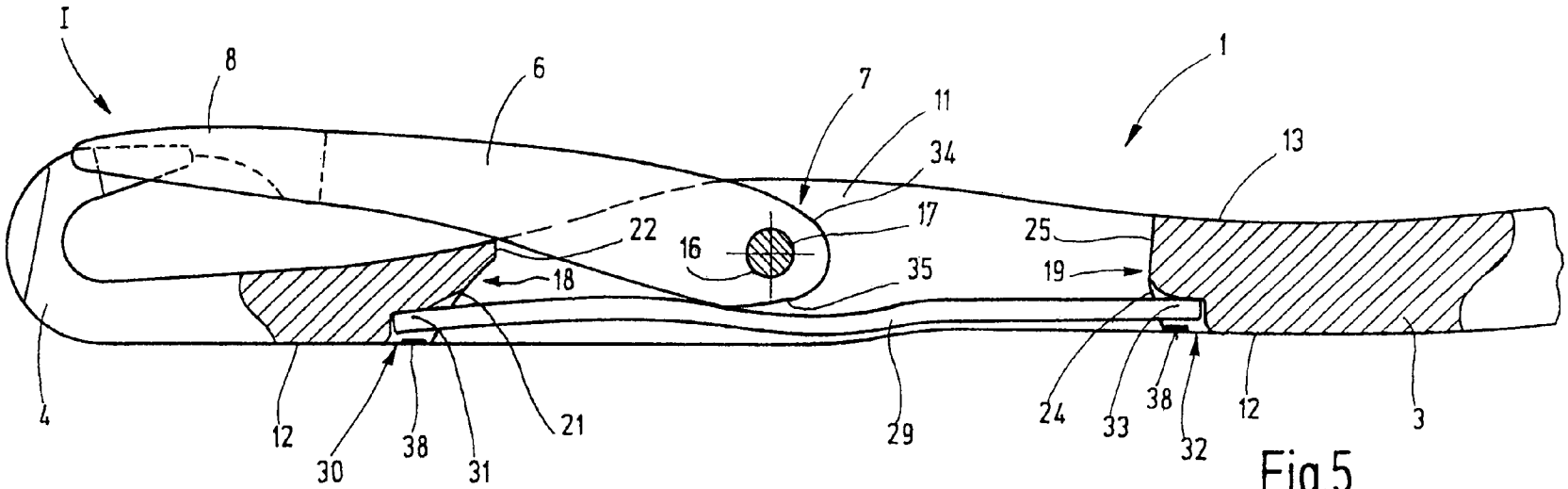
FIG. 5 is a fragmentary, longitudinally partially sectional illustration of a further embodiment of the latch needle according to the invention, showing the latch in its closed position.
Figure 6:
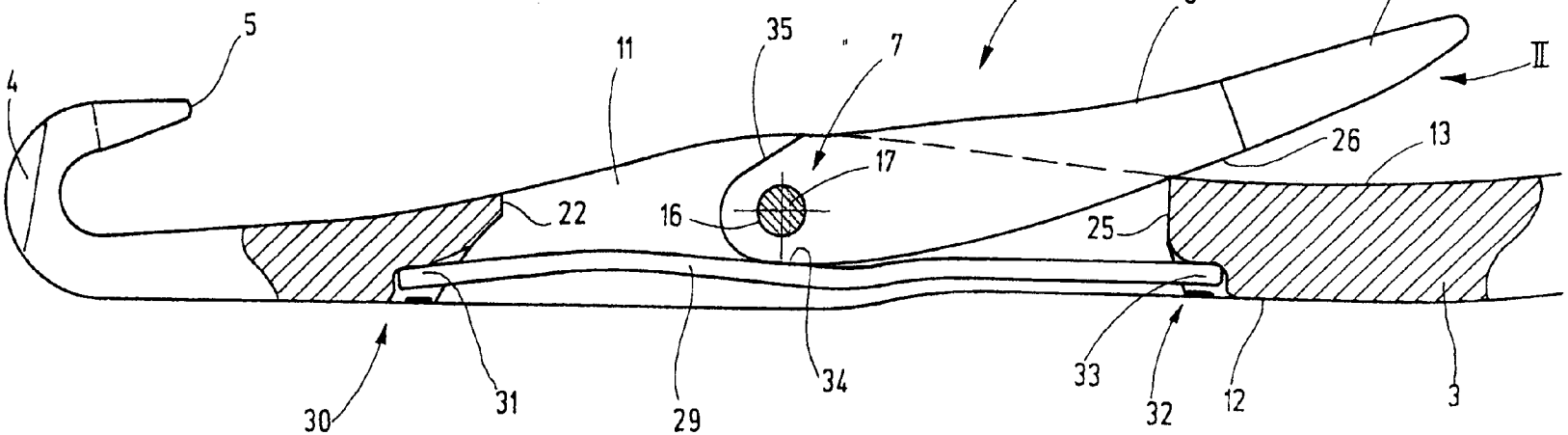
FIG. 6 shows the latch needle of FIG. 5, illustrating its latch in the reverse position.

FIGS. 5 to 8 show modified embodiments of the latch needle 1 provided with a latch spring 29 which, in each instance, is disposed in the sawslot 11. The embodiment of the latch needle 1 according to FIGS. 5 and 6 is characterized by a relatively short sawslot 11. As to the general configuration of the latch needle 1, reference is made to the description of the embodiment of the latch needle 1 according to FIG. 2 which applies in this case. In addition:

The end surface 18 is provided with a recess 30 which forms a support pocket or support seat for the latch spring 29. The latter has a bar shape and is essentially rectilinear. It may have a circular, oval or flattened cross section. The latch spring forms a flexural spring which, with its end 31, lies in the recess 30. The recess 30 is open toward the needle back 12, but is slightly constricted, so that the end 31 is held captive in the recess 30.

The oppositely located end surface 19 is likewise provided with a recess 32 which receives an end 33 of the latch spring 29. Again, a needle back-side constriction 38 of the otherwise open recess 32 prevents the end 33 of the latch spring 29 from falling out, whereby the latch spring 29 is held captive in the sawslot 11.

The end surface 19 is divided into the surfaces 25, 24, wherein the surface 25 may be preferably, but not necessarily a planar surface. It is, as previously noted, preferably parallel to the surface 22. As previously described, the surface 24 may be arcuate and may be oriented obliquely or perpendicularly to the length direction L of the shank.

The latch 6 impacts on the needle breast-side end of the surface 22 to assume the closed position I. This occurrence results in a shifting of the dirt, deposited on the surface 22, in the direction of the latch spring 29. Then the dirt moves past the latch spring 29 and exits the sawslot 11. In this connection it is advantageous to provide that the latch spring 29 occupies only one part of the width of the sawslot 11.

The latch spring may be utilized to ensure that the latch 6 assumes various preferred positions. For this purpose that end of the latch 6 which is situated within the sawslot 11 may be provided with flattened portions 34, 35 which are associated with the selected latch positions and which lie against the latch spring 29 in the respective selected-positions. The latch spring 29 engages the end of the latch 6 with a bias.

In the present embodiment the arrangement is preferably such that the preferred positions set by the latch spring 29 are in each instance at least slightly spaced from the closed position I as well as from the reverse position II. It is, however, also feasible, as illustrated in FIG. 6, to coordinate the bending of the latch spring 29 with the position of the flattened portion 34 such that the latch 6 is immobilized immediately or shortly ahead of the reverse position in which the latch 6 lies with its back 26 against that end of the surface 25 which adjoins the needle breast 13.

Figure 6B:
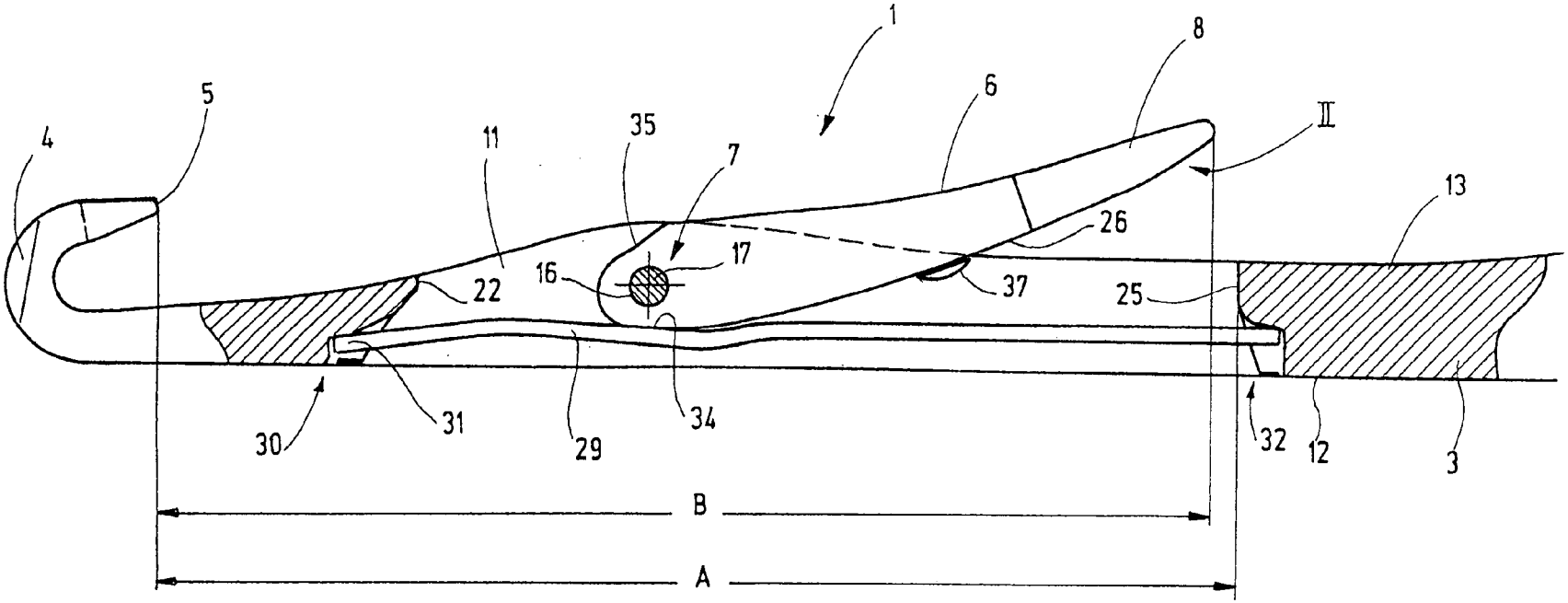
FIG. 6*b* is a fragmentary, longitudinally partially sectional illustration of a modified embodiment of the latch needle of FIG. 5 having a larger sawslot.

The embodiment of the latch needle 1 according to FIG. 6*b* is to a large extent identical to the latch needle of FIGS. 5 and 6 and it has the same properties as the latch needle according to FIG. 2*b*. Consequently, the earlier description applies with the same reference numerals. In addition:

The distance A from the hook tip 5 to the surface 25 of the end surface 19 of the sawslot 11 is greater than, or at least as large as the distance B from the hook tip 5 to the end of the latch spoon 8. As a result, the seat for the latch spoon is constituted exclusively by the embossment 37, whereby a particularly flexible latch needle is obtained.

Figure 7:
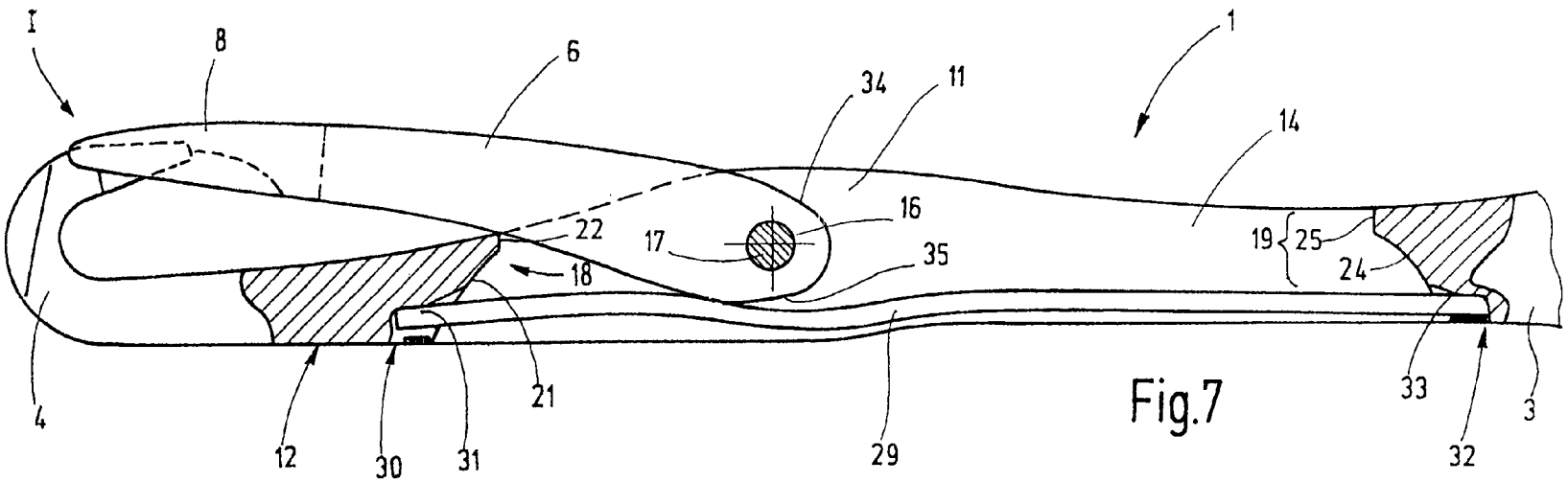
FIG. 7 is a fragmentary, longitudinally partially sectional illustration of an embodiment of the latch needle according to the invention, showing its latch in the closed position
Figure 8:
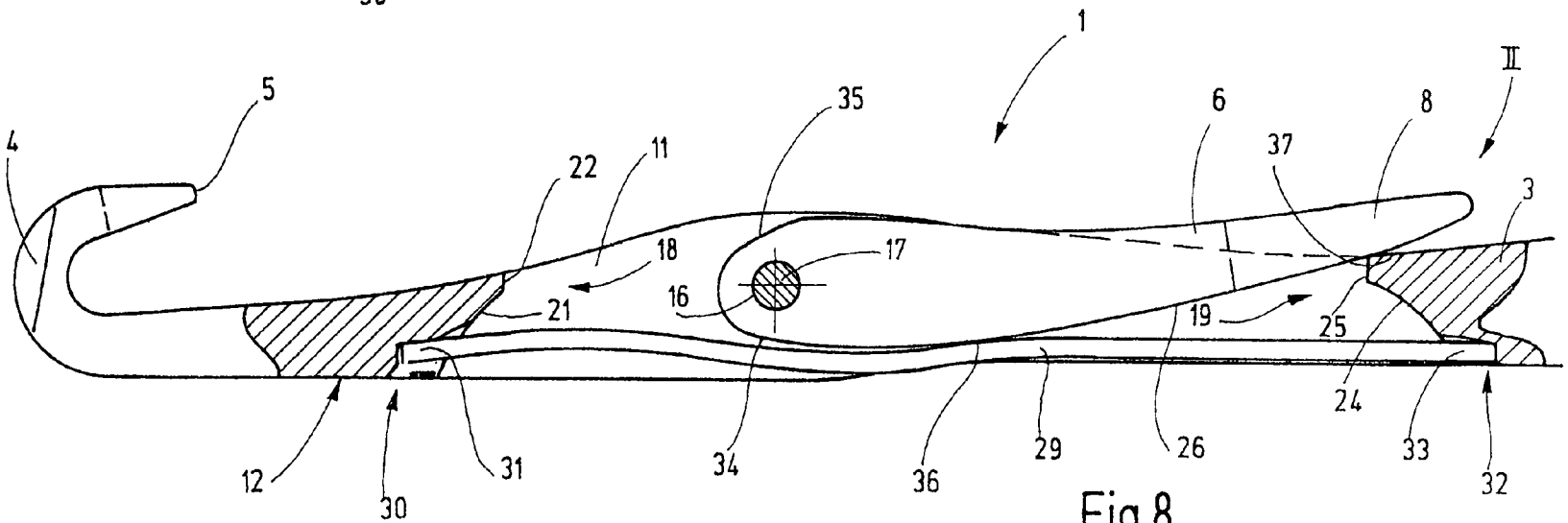
FIG. 8 shows the latch needle of FIG. 7, illustrating its latch in the reverse position.

The embodiment of the latch needle 1 illustrated in FIGS. 7 and 8 agree to a large extent with the embodiment of the latch needle 1 of FIGS. 5 and 6. Consequently, the earlier description applies with the same reference numerals. In addition:

The sawslot 11 has a significantly increased length in contrast to the earlier-described embodiment. Consequently, in its reverse position II, the latch 6 may be moved significantly closer to the shank 3 than in the previously described embodiment. The latch spring 29 has again a length for bridging the entire length of the sawslot 11. The flattened portions 34, 35 are, however, disposed in such a manner that they both hold the latch 6 in a stable position slightly spaced from the reverse position II or, respectively, the closed position I. For this purpose the latch spring 29 is, for example, at a location 36 spaced from the flattened location 34, additionally provided with a kink which contacts the back 26 shortly before the spoon 8 assumes its seat on the embossment 37.

The particularly long sawslot 11 results in relatively flexible cheeks 14, 15 which may lead to improved dynamic properties of the latch needle 1 (the cheek 15 is cut away and thus not visible in FIGS. 7 and 8).

With the latch needle 1 of FIGS. 7 and 8 too, an improved dirt removal is obtained by means of the sawslot 11 which widens toward the needle back 12 and particularly by means of the surfaces 22, 25 which are oriented perpendicularly to the needle back 12 and which immediately adjoin the latch 6. Further, a tendency to accumulate dirt at the end surfaces 18, 19 is significantly reduced.

A novel latch needle has a sawslot 11 which is provided with facets or surfaces 22, 25 both at its frontal and its rearward end surfaces 18, 19. The surfaces 22, 25 are preferably parallel to one another and are oriented perpendicularly to the direction of length L of the shank. By virtue of this arrangement the surfaces are so oriented that the latch 6, as it opens or closes, pushes any dirt past the respective surfaces through the sawslot 11 and thus an accumulation and compacting of dirt cushions on the noted surfaces is avoided. Generally stated, the sawslot 11, particularly in the region of its end surfaces 18, 19 is thus void of any surface regions which represent an obstacle to the opening or closing latch 6.

It will be appreciated that the above description of the present invention is susceptible to various medications, changes and adaptations, and the same are intended to be comprehended within the meaning and range of equivalents of the appended claims.

LIST OF REFERENCE CHARACTERS

1 latch needle
2 needle body
3 shank
4 hook
5 hook tip
6 latch
7 latch bearing
8 spoon
9 butt
10 transfer spring
11 sawslot
12 needle back
13 needle breast
14, 15 cheek
16 latch hole
17 pin
18, 19 end surfaces
21, 22 surfaces
23 inner side
24, 25 surfaces
26 back
27 depression
28 bottom
29 latch spring
32, 30 recess
31, 33 end
34, 35 flattened portions
36 location
37 embossment
38 constriction
I closed position
II reverse position
A, B distance
L length direction of the shank
N normal direction

The invention claimed is:

1. A latch needle for textile machines, comprising:

a needle shank which has a needle breast and a needle back and in which a sawslot is formed, a latch which is supported in the sawslot for a pivotal motion between a closed position (I) and a reverse position (II), wherein the length of the sawslot measured in the length direction (L) of the shank decreases inward in a direction away from the needle back, the sawslot is bordered in the length direction (L) of the shank by at least one surface which adjoins the needle breast and which is oriented essentially perpendicularly or at an obtuse angle to the length direction (L) of the shank and which is facing away from the needle breast, and the distance (A) of the surface from the hook tip is at least as large as the distance (B) from the hook tip to the end of the latch spoon when the latch is in the reverse position.

2. The latch needle as defined in claim 1, wherein the distance (A) of the surface from the hook tip is greater than the distance (B) from the hook tip to the end of the latch spoon when the latch is in the reverse position.

3. A latch needle for textile machines, comprising:

a needle shank which has a needle breast and a needle back and in which a sawslot is formed, a latch which is supported in the sawslot for a pivotal motion between a closed position (I) and a reverse position (II), the length of the sawslot measured in the length direction (L) of the shank decreases inward in a direction away from the needle back, and the sawslot is bordered in the length direction (L) of the shank by two parallel surfaces which adjoin the needle breast.

4. The latch needle as defined in claim 1, wherein the sawslot has a free passage to the needle back.

5. The latch needle as defined in claim 1, wherein a latch spring is disposed in the sawslot.

6. The latch needle as defined in claim 3, the surfaces adjoining the planar surfaces are arcuate.

7. A latch needle for textile machines comprising a needle shank which has a needle breast and a needle back and in which a sawslot is formed, a latch which is supported in the sawslot for a pivotal motion between a closed position (I) and a reverse position (II), and wherein:

the length of the sawslot, measured in the length direction (L) of the shank, decreases inward away from the needle back;

the sawslot is bordered in the length direction (L) of the shank by at least one surface which adjoins the needle breast and which is oriented essentially perpendicularly or at an obtuse angle to the length direction (L) of the shank and which is facing away from the needle breast;

the sawslot is open toward the needle back; and, opposite the at least one surface oriented essentially perpendicularly to the length direction (L) of the shank, a second surface is disposed which adjoins the needle breast and which is parallel to the first surface.

8. The latch needle as defined in claim 1, wherein the latch at least in the closed position (I) or at least in the reverse position (II) contacts the surface which adjoins the needle breast and which is oriented perpendicularly to the length direction (L) of the shank.

9. The latch needle as defined in claim 1, wherein the sawslot is bordered by parallel flanks.

10. The latch needle as defined in claim 1, wherein in the sawslot, an embossment is provided, serving as a latch abutment; and the embossment is in the form of a plastically deformed sawslot region.

11. The latch needle as defined in claim 3, wherein the sawslot has a free passage to the needle back.

12. The latch needle as defined in claim 3, wherein a latch spring is disposed in the sawslot.

13. The latch needle as defined in claim 3, wherein the latch, at least in the closed position (I) or at least in the reverse position (II), contacts the surface which adjoins the needle breast and which is oriented perpendicularly to the length direction (L) of the shank.

14. The latch needle as defined in claim 7, wherein the latch, at least in the closed position (I) or at least in the reverse position (II), contacts the surface which adjoins the needle breast and which is oriented perpendicularly to the length direction (L) of the shank.

15. The latch needle as defined in claim 3, wherein the sawslot is bordered by parallel flanks.

16. The latch needle as defined in claim 7, wherein the sawslot is bordered by parallel flanks.

17. The latch needle as defined in claim 3, wherein an embossment is provided in the sawslot, with the embossment serving as a latch abutment; and the embossment is in the form of a plastically deformed sawslot region.

18. The latch needle as defined in claim 7, wherein an embossment is provided in the sawslot, with the embossment serving as a latch abutment; and the embossment is in the form of a plastically deformed sawslot region.

* * * * *